US006557739B1

(12) United States Patent
Pursley et al.

(10) Patent No.: US 6,557,739 B1
(45) Date of Patent: May 6, 2003

(54) HOLDER FOR HEADED TOOLS

(76) Inventors: Richard Wayne Pursley, 54554 30th St., Paw Paw, MI (US) 49079; Stephen David Roberts, 1102 Stafford, Kalamazoo, MI (US) 49006

( * ) Notice: Subject to any disclaimer, the term of this patent is extended or adjusted under 35 U.S.C. 154(b) by 0 days.

(21) Appl. No.: 09/891,708

(22) Filed: Jun. 26, 2001

(51) Int. Cl.[7] ..... A45F 5/00; A45F 5/14

(52) U.S. Cl. ..... 224/268; 224/234; 224/248; 224/677; 224/678

(58) Field of Search ..... 224/904, 678, 224/247, 248, 234, 268, 677

(56) References Cited

U.S. PATENT DOCUMENTS

| | | | | |
|---|---|---|---|---|
| 1,274,312 A | | 7/1918 | Nicall | |
| 2,956,715 A | | 10/1960 | Henderson | |
| 3,100,590 A | | 8/1963 | Bohlsen | |
| 3,130,883 A | * | 4/1964 | MacKool | 224/222 |
| 3,294,298 A | | 12/1966 | Danielson | |
| 3,343,735 A | | 9/1967 | Breeding et al. | |
| 4,830,247 A | * | 5/1989 | Banks | 211/70.6 |
| 5,213,242 A | | 5/1993 | de Jong | |
| 5,232,136 A | | 8/1993 | Unger | |
| 5,232,137 A | | 8/1993 | Devine | |
| 5,605,263 A | | 2/1997 | Pursley et al. | |
| 6,237,822 B1 | * | 5/2001 | Vidal | 224/234 |

* cited by examiner

*Primary Examiner*—Stephen P. Garbe
(74) *Attorney, Agent, or Firm*—Joseph K. Andonian

(57) ABSTRACT

A device for securing a T-shaped tool such as a hammer to the leg of a user in a position which provides complete freedom of movement of hands and feet while carrying the tool and permits the user to remove the tool from the device with the same hand employed to use the tool.

3 Claims, 1 Drawing Sheet

HOLDER FOR HEADED TOOLS

This invention relates to an improved holder for T-shaped headed tools.

BACKGROUND OF THE INVENTION

The background of the invention is adequately described in our U.S. Pat. No. 5,605,263, which is incorporated herein by reference. This invention is an improved version of the holder described in that patent. Most significantly, the present improvement is simpler in construction and therefor much more economical to produce and yet maintains the advantages of the earlier holder.

Thus it is an object of this invention to provide a simpler and more economical device for carrying a hammer or similar T-shaped headed tool safely, securely and conveniently without interfering with the free use of hands and feet while carrying the tool.

It is also an object of this invention to provide a simpler and more economical holder for carrying a T-shaped tool having a head and a handle and enabling the wearer of the holder to grasp the handle of the tool in the same hand both to use or holster the tool.

Other objects will be apparent from the description that follows.

SUMMARY OF INVENTION

Like its predecessor the present invention provides a device capable of carrying a hammer or a similar T-shaped tool having a head and a handle on the body in a convenient manner for safe and efficient use. The present invention also provides means for securing the hammer above or below the knee with the head below the handle so the user can grip the hammer by the handle in the same hand during use or holstering. Also like its predecessor a hammer is firmly held in the holder by both the handle and the head using a clamp to secure the handle and a cradle to nest the head. A simpler and less costly construction is employed to accommodate various sizes of handles.

The device of the present invention comprises three components fastened together to secure a T-shaped tool in an inverted position against the leg of the wearer of the device. The first component is configured to provide a cradle for the head at its lower end and two largely parallel side rails extending upwardly in relation to said cradle. The side rails are threaded through openings provided in the pliable second component which acts as a back wall for the device. The third component is a clamp which is fastened to the side rails and the back wall at various positions to accommodate different sized tool handles. The second component also provides means located above the side rails for fastening the device to the belt of the wearer.

The designation of movements or positions throughout the present specification, such as horizontal or vertical movements of the tool or up and down positions on the holder, assume that the head of the tool is down in the cradle or the handle is extended upward away from the head like an inverted letter T, the normal arrangement if the wearer of the holder is standing in an upright position with the tool placed in the holder.

LIST OF REFERENCE NUMERALS

Figure 1:
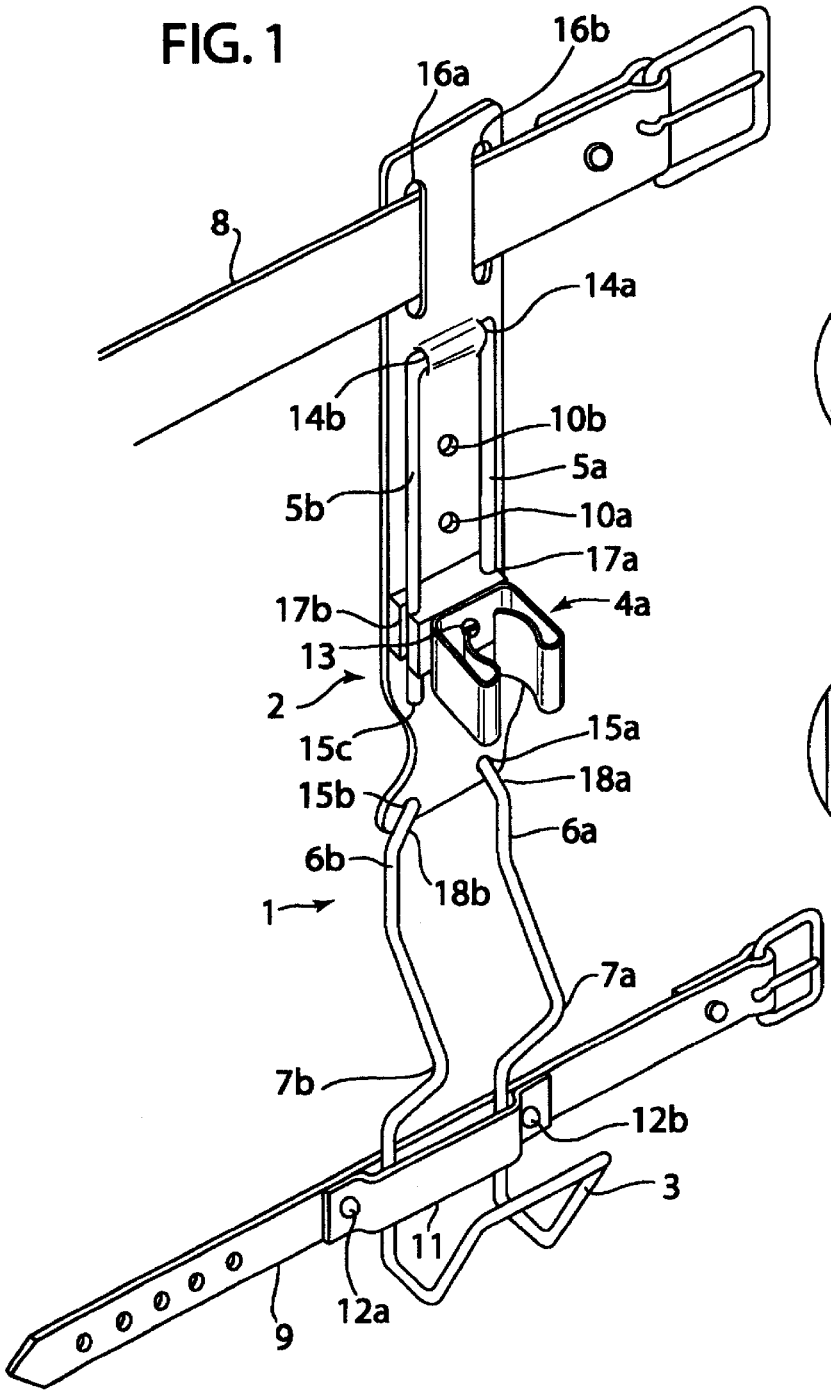
FIG. 1 provides a perspective view of the holder.

1 Metal rod or first component configured to provide side rails and cradle
2 Back wall or second component of holder
3 Cradle
4*a,* 4*b* and 4*c* Various clamp alternatives for third component
5*a* and 5*b* Narrow segment of side rails
6*a* and 6*b* Wide segment of side rails
18*a* and 18*b* Angled inwardly segment of side rails
7*a* and 7*b* Raised segment of side rails
8 Upper strap or belt
9 Lower strap
10*a* and 10*b* Alternative openings in back wall suitable for attaching clamp
11 Retainer on lower strap 9 to fasten cradle end of side rails to leg of user
12*a* and 12*b* Retainer fasteners
13 Clamp fastener
14*a* and 14*b* Holes in upper end of back wall 2 to accommodate open end of side rails
15*a,* 15*b* and 15*c* Holes in lower end of back wall 2 to accommodate side rails
16*a* and 16*b* Slotted openings in top of back wall 2
17*a* and 17*b* Clamp channels

DETAILED DESCRIPTION

The preferred embodiment of the present invention is especially designed to hold a hammer and consists essentially of three components:

(1) a metal rod 1 configured to form a cradle 3 to hold the hammerhead at one end and side rails including five segments, namely segments 7*a* and 7*b* raised above the plane occupied by said second component 2 (back wall) to limit the horizontal movement of the hammer handle, parallel segments 6*a* and 6*b* extending upwardly from said raised segments and spaced about as far apart as said raised segments, segments 18*a* and 18*b* angled inwardly and extending upwardly from segments 6*a* and 6*b,* parallel segments 5*a* and 5*b* extending upwardly from said inwardly angled segments and spaced closer together than said segments 6*a* and 6*b,* and the last segment angled still further inwardly above segments 5*a* and 5*b* and fastened together after being threaded through the openings provided in said back wall 2.

(2) a pliable back wall 2 into which the open end of metal rod 1 can be threaded through openings 15*a,* 15*b,* 15*c,* 14*a* and 14*b* with slotted openings 16*a* and 16*b* to facilitate attachment to the belt 8 or, with a separate strap, to the leg of the user and (3) a clamp affixed both to side rails sections 5*a* and 5*b* and the back wall 2 to limit the movement of the hammer handle in any direction.

An optional leather or plastic strap 9 with a leather or plastic retainer 11 can be employed to tie the cradle end of the holder more firmly to the leg of the user much like the lower end of holster of a hand gun is often tied. The retainer 11 is attached loosely enough to strap 9 by fasteners 12*a* and 12*b* to allow the cradle 3 to fit between the retainer 11 and strap 9. A strap can be used instead of the belt of the wearer to secure the top of the device particularly if the holder is worn below the knee of the wearer, a location appropriate to roofers who often work on their knees.

The first component 1 is preferably fashioned from a metal rod that is preferably bent to form a cradle 3 at the closed lower end of two largely parallel side rails 1. The cradle 3 is raised above the plane occupied by the side rails 1 and is sized to hold the head of a hammer. The side rails 1 extend away from the cradle 3 to an initially open end (not shown). Opposing segments 7*a* and 7*b* of the side rails 1 are raised in the same direction as the cradle 3 and, in combination with the clamp 4*a,* helps to limit the horizontal movement of the hammerhead when the hammer is placed in the holder. The distance between segments 6*a,* 6*b,* 7*a* and 7*b* of the side rails 1 is greater than the expected width of the handle of the hammer to be placed in the holder as well as the remaining segments 5*a* and 5*b* of the side rails 1. Although also greater than the expected width of the hammer handle, the distance between segments 5*a* and 5*b* of side rails 1 is less than the distance between the other segments of the side rails 1. That difference is accomplished by angling the side rails inwardly at 18*a* and 18*b* and helps to secure the side rails 1 more securely when threaded into the back wall 2 helping to prevent the side rails 1 from sliding up or down in the back wall 2. The two segments that form the open end of the side rails 1 are threaded into the back wall 2 of the holder first through holes 15*a* and 15*b,* then through holes 15*c* and its unseen counterpart, and finally through holes 14*a* and 14*b.* Such threading helps to limit movement of the side rails 1 especially after the open ends of the side rails 1 are fastened together, preferably by welding, after the threading is completed. It is also desirable for the open ends of the side rails 1 to be bent toward each other to limit the space between the side rails 1 before welding the open ends together.

The second component 2 is preferably fashioned out of leather or plastic. It provides holes 15*a,* 15*b,* 15*c,* 14*a* and 14*b* through which the open ends (not shown) of the side rails 1 can be threaded. A hole opposite and equivalent to hole 15*c* is not visible through the clamp 4*a* in FIG. 1. The vertical separation of holes 15*a,* 15*b* from 15*c* and its opposing hole (not shown) is less than the distance holes 14*a* and 14*b* are from 15*c* and its unseen counterpart. This arrangement provides greater flexibility for locating the clamp 4*a* on the back wall 2, for example by fastening the clamp through hole 10*a* or 10*b* in place of or in addition to the location shown in FIG. 1.

Figure 2:
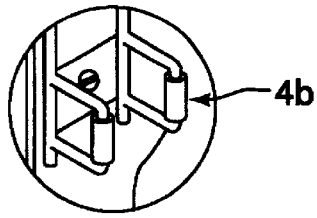
FIGS. 2 and 3 illustrate different versions of the clamp used to hold the handle firmly in the holder.
Figure 3:
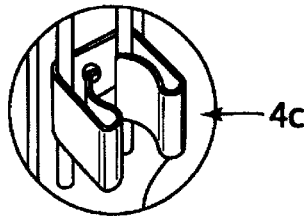

The third component of the preferred embodiment is the clamp 4*a.* Other suitable clamps 4*b* and 4*c* are depicted in FIGS. 2 and 3. The principal requirement is that the clamp be capable of holding the hammer handle firmly enough to prevent the hammer from movement in any direction under the conditions of ordinary use and yet not so firmly as to prevent the user from removing the hammer from the holder without excessive effort. The clamp 4*a* is fastened to the back wall 2 by a bolt 13 and a nut (not shown). The base of the clamp 4*a* is also fitted between the narrower portions 5*a* and 5*b* of the side rails 1 preferably in slotted channels 17*a* and 17*b.* The clamp 4*a* is partly metal and partly plastic but many other materials or combinations are possible. All metal, all plastic or combinations of plastic, metal and compressible materials such as rubber can be used. FIG. 2 displays a clamp that consists of rubber and metal, and is welded to the side rails 1. FIG. 3 displays a clamp that is all metal and is press fitted to the side rails 1. Clamp 4*a* with slotted channels 17*a* and 17*b* can slide up and down side rail sections 5*a* and 5*b* and fasten to the back wall 2 through holes 10*a,* 10*b* and their unseen counterpart as shown in FIG. 1.

The present invention differs primarily from its predecessor described in U.S. Pat. No. 5,605,263 by its one piece instead of two piece side rails and the elimination of the belt that held the two piece side rails together while providing flexibility in the effective length of the holder. Instead of varying the length of the holder by sliding the two piece side rails closer together or further apart as in the patent, different sized hammer handles can be accommodated in the present invention by moving the clamp up and down. It was also discovered that clamps are now available that will hold the hammer firmly enough to eliminate the need for the stop at the top of one component of the side rails described in the patent. Finally it was discovered that a clip to attach the patented assembly to the belt was unnecessary and that slots 16*a* and 16*b* in the top portion of the back wall 2 could serve the same purpose. The lower strap designed to strap the cradle end of the holder to the leg also proved to be unnecessary especially to taller users who worked in a standing position although it was still very useful to those who worked on their knees. However, instead of providing slots in the back wall as contemplated by the patented holder, the lower strap 9 of the present invention was attached to the holder of the present invention by using a retainer 11 and sliding the cradle into the opening between the retainer 11 and belt 9. The end result of the present invention was a simpler and less costly device that serves the same purpose as the patented holder.

The advantages of the described invention like its patented predecessor include the ability of the holder (1) to secure the tool in two separate locations and at various elevations on the leg, (2) to accommodate tools of various lengths with heads of various sizes and shapes, (3) to restrict vertical movement by the combination of a clamp and a cradle, (4) to restrict horizontal movement by the combination of a clamp, a cradle and the raised portions of the side rails and (5) to accomplish all of the foregoing in a simpler and a much more economical way.

The products disclosed herein represent preferred embodiments of the invention. Many other variations are possible but are too numerous to disclose in their entirety. The words and drawings used and disclosed herein are merely descriptive and illustrative and are not intended as exact representations of, or inflexible limitations on, the spirit and scope of the invention disclosed herein. The invention can only be measured by the legally valid scope of any claims eventually issued in a subsequent patent.

What is claimed is:

1. A device comprising three components fastened together to secure a T-shaped tool having a head and a handle against the leg of a wearer of the device with said handle extending upwardly in relation to said head and to said wearer when standing upright, said device comprising A first component configured to provide a cradle for said head at its lower end and two largely parallel side rails adapted in combination with said second and third components to secure said T-shaped tool in said device, A second component of a pliable material into which said side rails are threaded upwardly through openings in said second component, said second component also providing means for attaching the device to the belt of the wearer and A third component comprising a clamp suitable for holding the handle of said T-shaped tool and adapted for attachment to both said side rails and said second component wherein said side rails comprise five segments above said cradle A first segment spaced furthest apart of the five segments and raised above the plane occupied by said second component, A second parallel segment above and about as far apart as said first segment, A third segment angled inwardly and extending upwardly above said second segment, A fourth entirely parallel segment extending upwardly above said third segment and spaced closer together than said second segment, and A fifth segment angled still further inwardly above said fourth segment and fastened together after being threaded through the openings provided in said second component of the device.

2. A device comprising three components fastened together to secure a T-shaped tool having a head and a handle against the leg of a wearer of the device with said handle extending upwardly in relation to said head and to said wearer when standing upright, said device comprising A first component configured to provide a cradle for said head at its lower end and two largely parallel side rails adapted in combination with said second and third components to secure said T-shaped tool in said device, A second component of a pliable material into which said side rails are threaded upwardly through openings in said second component, said second component also providing means for attaching the device to the belt of the wearer and A third component comprising a clamp suitable for holding the handle of said T-shaped tool and adapted for attachment to both said side rails and said second component wherein a strap is provided to affix the lower end of the device to the leg of the wearer of the device, said strap including a retainer affixed loosely enough to said strap to enable the cradle to pass through the space between said retainer and said strap.

3. A device comprising three components fastened together to secure a T-shaped tool having a head and a handle against the leg of a wearer of the device with said handle extending upwardly in relation to said head and to said wearer when standing upright, said device comprising A first component configured to provide a cradle for said head at its lower end and two largely parallel side rails adapted in combination with said second and third components to secure said T-shaped tool in said device, A second component of a pliable material into which said side rails are threaded upwardly through openings in said second component, said second component also providing means for attaching the device to the belt of the wearer and A third component comprising a clamp suitable for holding the handle of said T-shaped tool and adapted for attachment to both said side rails and said second component wherein said clamp is configured to provide channels for enclosing said side rails and an opening to accommodate a fastener which is suitable for attaching said clamp to said second component and wherein said clamp can slide up and down along said side rails and can be fastened to said second component in any one of the openings in said second component positioned between said side rails to accommodate tool handles of varying length.

* * * * *